US008892012B2

(12) United States Patent
Matsunaga

(10) Patent No.: US 8,892,012 B2
(45) Date of Patent: Nov. 18, 2014

(54) DEVELOPMENT DEVICE AND IMAGE FORMING APPARATUS

(71) Applicant: Oki Data Corporation, Tokyo (JP)

(72) Inventor: Shogo Matsunaga, Tokyo (JP)

(73) Assignee: Oki Data Corporation, Tokyo (JP)

( * ) Notice: Subject to any disclaimer, the term of this patent is extended or adjusted under 35 U.S.C. 154(b) by 117 days.

(21) Appl. No.: 13/770,369

(22) Filed: Feb. 19, 2013

(65) Prior Publication Data

US 2013/0216279 A1 Aug. 22, 2013

(30) Foreign Application Priority Data

Feb. 20, 2012 (JP) ..... 2012-033520

(51) Int. Cl.
*G03G 15/08* (2006.01)

(52) U.S. Cl.
CPC ..... *G03G 15/08* (2013.01); *G03G 15/0818* (2013.01)
USPC ..... 399/286

(58) Field of Classification Search
USPC ..... 399/286; 430/123.3
See application file for complete search history.

(56) References Cited

U.S. PATENT DOCUMENTS 4,011,834 A * 3/1977 Stephan ..... 399/284
4,331,754 A * 5/1982 Stephan ..... 430/102
5,547,724 A * 8/1996 Kuribayashi ..... 428/35.8
6,026,265 A * 2/2000 Kinoshita et al. ..... 399/281
6,115,575 A * 9/2000 Kinoshita et al. ..... 399/286
7,361,400 B2 * 4/2008 Shimamura et al. ..... 428/323
2003/0232185 A1 * 12/2003 Shimamura et al. ..... 428/323
2006/0275598 A1 * 12/2006 Shimamura et al. ..... 428/323
2007/0003331 A1 * 1/2007 Kawano et al. ..... 399/286
2007/0092702 A1 * 4/2007 Shimamura et al. ..... 428/195.1
2007/0154834 A1 * 7/2007 Shimamura et al. ..... 430/123.3
2008/0193172 A1 * 8/2008 Kusaba et al. ..... 399/286
2008/0220363 A1 * 9/2008 Uchino et al. ..... 430/125.5
2008/0292366 A1 * 11/2008 Akama et al. ..... 399/286

FOREIGN PATENT DOCUMENTS

JP 2010-152024 A 7/2010

* cited by examiner

*Primary Examiner* — G. M. Hyder

(74) *Attorney, Agent, or Firm* — Muncy, Geissler, Olds & Lowe, P.C.

(57) ABSTRACT

A development device includes a developer carrier configured to supply developer on a latent image formed on a latent image carrier to visualize the latent image. Wherein the developer carrier includes: an elastic layer formed on an outer circumferential surface of a conductive support body, the elastic layer including urethane rubber; and a top layer formed by treating a surface of the elastic layer with treatment solution that includes urethane polymer, silicone-based additive and conductive agent. The top layer includes convex parts that include the urethane rubber and concave parts in which the silicone-based additive and the conductive agent are laminated.

13 Claims, 6 Drawing Sheets

DEVELOPMENT DEVICE AND IMAGE FORMING APPARATUS

CROSS REFERENCE TO RELATED APPLICATION

The present application is related to, claims priority from and incorporates by reference Japanese Patent Application No. 2012-033520, filed on Feb. 20, 2012.

TECHNICAL FIELD

The present invention relates to a development device that develops an electrostatic latent image formed on a photosensitive body and an image forming apparatus.

BACKGROUND

Generally, a replaceable development device for a printer as an image forming apparatus mainly includes a development roller that develops a toner image by attaching toner as developer onto an electrostatic latent image formed on the photosensitive body, a toner supply roller that supplies toner on the development roller, a development blade that regulates a thickness of the toner supplied on the development roller, a charge roller that uniformly and evenly charges the photosensitive body and the like.

In the development device with such a configuration, a surface of a development roller is treated with a urethane solution to give appropriate durability and a stable charge property (e.g. see JP Laid-Open Patent Application No. 2010-152024).

However, it is difficult to obtain a favorable image since it is difficult for developer on a conventional developer carrier to be appropriately charged.

Specific examples illustrated in the present invention aim to improve image quality.

SUMMARY

Considering the object above, a development device is disclosed, which includes a developer carrier configured to supply developer on a latent image formed on a latent image carrier to visualize the latent image. Wherein the developer carrier includes: an elastic layer formed on an outer circumferential surface of a conductive support body; the elastic layer including urethane rubber; and a top layer formed by treating a surface of the elastic layer with treatment solution that includes urethane polymer, silicone-based additive and conductive agent. The top layer includes convex parts that include the urethane rubber and concave parts in which the silicone-based additive and the conductive agent are laminated.

The image quality is improved in the specific examples illustrated in the present invention.

DESCRIPTION OF EMBODIMENTS

Embodiments of the present invention are explained below with reference to the drawings. The present invention is not limited to the below descriptions but may be appropriately modified without departing from the scope of the embodiments.

[First Embodiment]

A printer is explained as an image forming apparatus according to the present invention. Next, a development device is explained.

Figure 1:
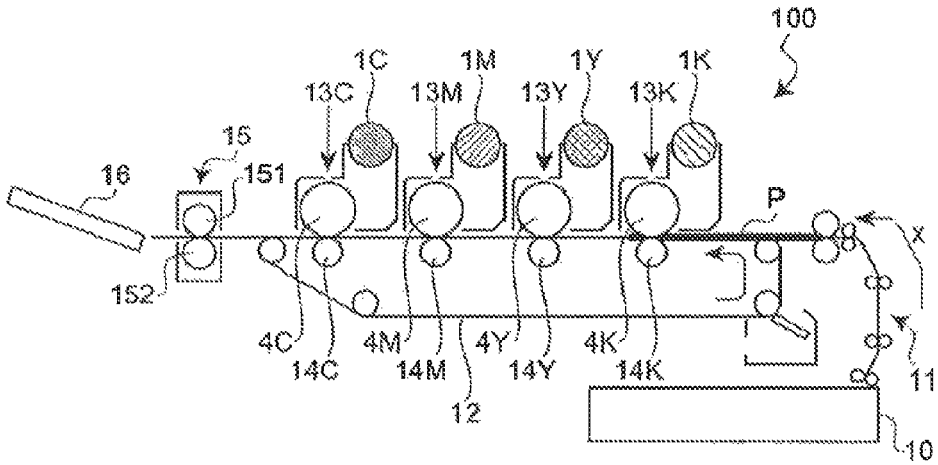
FIG. 1 is a schematic diagram for explaining a configuration of a printer.

FIG. 1 is a schematic diagram for explaining a configuration of a printer 100 as an image forming apparatus. The printer 100 is an electrographic image forming apparatus that forms an image on a sheet P as a recording medium. The printer 100 that realizes such a function includes a carrying roller 11, a transfer belt 12, and a fuser device 15 along a medium carrying path of which a sheet supply cassette 10 is a start point and a sheet ejection tray 16 is an end point.

A development device 1K as a development part that develops a black (K) developer image, a development device 1Y as a development part that develops a yellow (Y) developer image, a development device 1M as a development part that develops a magenta (M) developer image, and a development device 1C as a development part that develops a cyan (C) developer image are removably installed to the printer 100 main body on the upper surface part of the transfer belt 12 in order from the medium carrying path upstream side. In addition, each of LED (Light Emitting Diode) heads 13K, 13Y, 13M and 13C are arranged directly on a later-discussed photosensitive drum as a latent image carrier that each of the development devices includes. The LED (Light Emitting Diode) heads 13K, 13Y, 13M and 13C irradiate the surfaces of the photosensitive drums with light based on input image information to form a latent image. In addition, transfer rollers 14K, 14Y, 14M and 14C are arranged at positions in which the transfer rollers 14K, 14Y, 14M and 14C face the photosensitive drums across the upper surface part of the transfer belt 12. The transfer rollers 14K, 14Y, 14M, 14C transfer the developer image developed on the surface of the photosensitive drum onto the sheet P.

The sheet supply cassette 10 is accommodated in a state in which sheets P are stacked therein, and is removably installed in the lower part of the printer 100. The sheet supply cassette 10 feeds each of the accommodated sheets P in order from the top of the sheets P to a medium carrying path when a sheet feeding roller provided above the sheet supply cassette 10 rotates.

The carrying rollers 11 sandwich the sheet P fed from the sheet supply cassette 10 and carry the sheet P in an x direction in FIG. 1. The sheet P carried by the carrying roller 11 is carried to the transfer belt 12 while skew of the sheet P is corrected.

The transfer belt 12 is an endless belt member, performs electrostatic stiction of the sheet P, and carries the sheet P to the development device.

Each of the LED heads 13K, 13Y, 13M, 13C includes LED elements and a lens array, and is arranged at a position in which light radiated by the LED elements based on image information forms an image on the surface of the photosensitive drum.

Each of the transfer rollers 14K, 14Y, 14M, 14C is arranged at a position in which the transfer roller faces the photosensitive drum across the upper surface part of the transfer belt 12, and transfers the developer image developed on the surface of the photosensitive drum to the sheet P based on a predetermined bias voltage applied by a high pressure power source.

The fuser device 15 is arranged on the downstream side of the medium carrying path after the development devices 1K, 1Y, 1M and 1C, and includes a fuser roller 151 and a pressure application roller 152. The fuser roller 151 is formed by covering a hollow, cylindrical core made of aluminum or the like with a heat resistance elastic layer made of silicone rubber and by covering the heat resistance elastic layer with tetrafluoroethylene-perfluoroalkylvinyl ether copolymer (PFA) tube, for example. And then, a heater such as a halogen lamp or the like is provided in the core, for example. The pressure application roller 152 has a configuration in which the core made of aluminum or the like is covered by a heat resistance elastic layer covered with PFA thereon and made of silicone rubber. The pressure application roller 152 is arranged so that a contact part is formed between the fuser roller 151 and the pressure application roller 152 by a pressure force given by a spring, for example. When the sheet P, on which the developer image formed in the development devices 1K, 1Y, 1M and 1C is transferred, passes the contact part formed with the fuser roller 151 and the pressure application roller 152 maintained at a predetermined temperature, heat and pressure are given to the developer on the sheet P, the developer melts, and the developer image is fixed.

The sheet ejection tray 16 stacks the sheets P on which a developer image is fixed when the sheets P pass the fuser device 15.

The printer 100 includes a print control part, an interface control part, a reception memory, an image data edition memory, a display part, an operation part, various sensors, a head drive control part, a temperature control part, a sheet carrying motor control part, a drive control part, a high pressure power source and the like as other members configuring the printer 100 (not illustrated in FIG. 1). The print control part includes a microprocessor, a Read Only Memory (ROM), a Random Access Memory (RAM), an I/O port, a timer and the like. The interface control part receives image information and control commands, controls the whole sequence of the printer 100, and performs a print operation. The reception memory temporarily stores the image information input via the interface control part. The image data edition memory receives the image information stored in the reception memory, and stores formed image data by editing the image information. The display part includes a display device such as, for example, a Liquid Crystal Display (LCD) and the like for displaying a state of the printer 100. The operation part includes an input part such as, for example, a touch panel and the like for receiving an instruction of a user. The various sensors includes such as, for example, a sheet position detection sensor, a temperature and humidity sensor, a concentration sensor and the like for monitoring an operation state of the printer 100. The head drive control part sends the image data stored in the image data edition memory to the LED heads 13K, 13Y, 13M and 13C to control the drive of the LED heads 13K, 13Y, 13M and 13C. The temperature control part controls temperature of the fuser device 15. The sheet carrying motor control part controls a drive motor for rotating the carrying roller 11 that carries the sheets P, and the like. The drive control part controls a drive motor for rotating the various rollers such as photosensitive drum and the like. The high pressure power source applies a voltage to the various rollers.

Figure 2:
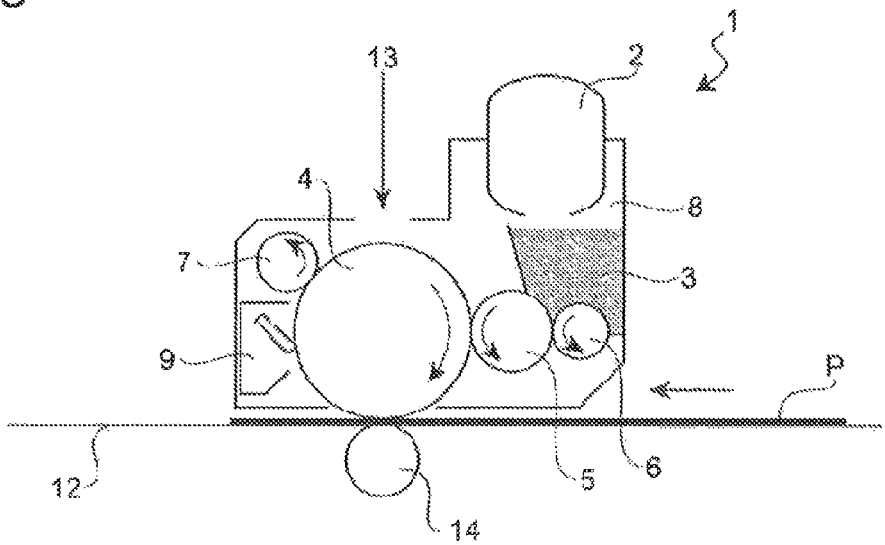
FIG. 2 is a schematic diagram for explaining a configuration of development devices.

Next, a configuration of the development devices is explained with reference to the FIG. 2. FIG. 2 is a schematic diagram for explaining a configuration of the development devices 1K, 1Y, 1M and 1C. Only toners as developer accommodated in the development devices 1K, 1Y, 1M and 1C are different and other configurations thereof are the same. Hereinafter, components are indicated with the same symbols without K, Y, M and C.

The development device 1 includes a toner cartridge 2 that accommodates toner 3, the toner 3, a photosensitive drum 4 as the latent image carrier, a development roller 5 as a developer carrier, a supply roller 6 that supplies the toner 3 on the development roller 5, a charge roller 7 that uniformly and evenly charges the surface of the photosensitive drum 4, a restriction blade 8 that restricts a thickness of the toner 3 on the development roller 5, a cleaning blade 9 that collects fog toner and transfer residual toner on the surface of the photosensitive drum 4.

The toner cartridge 2 includes an accommodation space that accommodates one of the toner 3 in black (K), yellow (Y), magenta (M) and cyan (C), and is removably installed to the development device 1.

The toner 3 includes binder resin, colorant that shows one of black (K), yellow (Y), magenta (M) and cyan (C), additive such as magnetic microparticle, charge control agent, release agent, and external additive. Polymerization toner made by a suspension polymerization method or an emulsion polymerization method or pulverization toner made by kneading pulverization method may be used for the toner 3, for example.

The photosensitive drum 4 is an organic photosensitive body configured by, for example, a metal shaft made of aluminum, an electric charge generation layer and an electric charge transportation layer as photosenductive layers layered on an outer circumferential surface of the metal shaft in order.

The development roller 5 includes an elastic layer formed on the outer circumferential surface of the core as a conductive support body and made of urethane rubber as a main component, and a top layer formed by treating a surface of the elastic layer with treatment solution that includes urethane polymer, silicone-based additive and conductive agent. Here, in order to increase adhesion of the elastic layer to the core, adhesive, primer or the like may be applied to the outer circumferential surface of the core as needed. In addition, the adhesive, the primer or the like may be conductive as needed. The development roller 5 is explained in detail later.

The supply roller 6 is configured by a metal shaft made of steel use machinerbility (SUM) and a conductive sponge layer, for example, and is polished to have a predetermined outer diameter.

The charge roller 7 is configured by a metal shaft and an ion conductive rubber elastic layer made of epichlorohydrin (ECO) rubber as a main component, for example. A surface treatment to penetrate surface treatment solution including isocyanate (HDI) component to harden the surface is performed on the surface of the rubber elastic layer. As a result, prevention of the photosensitive drum from contamination and release property of the toner and the external additive thereof, or the like are ensured.

The restriction blade 8 is formed of steel special use stainless (SUS) with a thickness of an approximately 0.1 mm and spring property, for example, and a front edge part of one end side thereof is outwardly bended in an L shape. And then, the front edge part of the one end side is arranged to abut on the development roller 5 with a predetermined contact force during later-discussed image formation operation.

The cleaning blade 9 is a rubber member made of urethane rubber, for example, and one end thereof is arranged to abut on a predetermined position of the surface of the photosensitive drum 4. In addition, a space to accommodate waste toner scraped off from the photosensitive drum 4 is provided under the cleaning blade 9. The accommodated waste toner is carried to a waste toner collector (not illustrated).

The photosensitive drum 4, the development roller 5, the supply roller 6 and the charge roller 7 rotate in respective arrows in FIG. 2. The predetermined bias voltage is applied to the transfer roller 14 arranged at a position in which the transfer roller 14 faces the rotating photosensitive drum 4, and the developer image developed on the surface of the photosensitive drum 4 is transferred to the sheet P at the timing when the sheet P carried by the transfer belt 12 arrives.

Figure 3A:
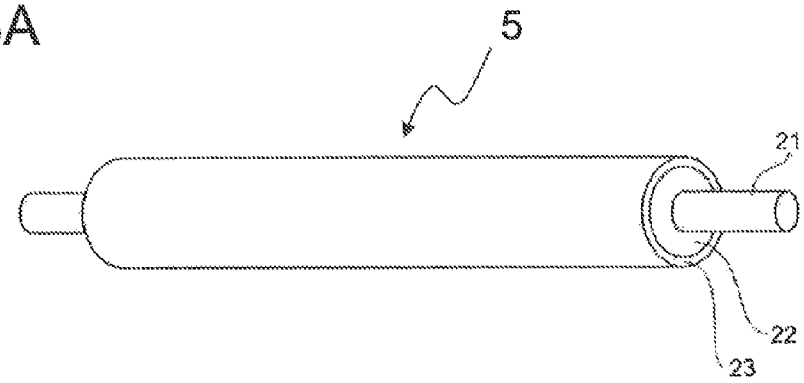
FIG. 3A is a schematic diagram for explaining a configuration of a development roller.
Figure 3B:
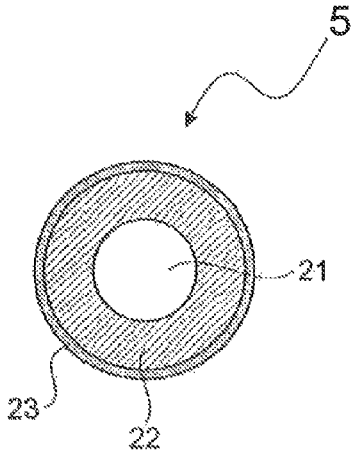
FIG. 3B is a schematic cross-sectional view of the development roller.

Next, the development roller 5 is explained. FIG. 3A is a schematic diagram for explaining a configuration of a development roller 5. FIG. 3B is a schematic cross-sectional view of the development roller 5.

As illustrated in FIGS. 3A and 3B, the elastic layer 22 is formed on the development roller 5. The elastic layer 22 is formed on the outer circumferential surface of the core 21 as a conductive support body made of SUM, and is made of urethane rubber as the main component. And then, the development roller 5 includes the top layer 23 formed by treating the surface of the elastic layer 22 with the treatment solution that includes electrification agent, surface modifier and conductive agent and the like after the surface of the elastic layer 22 has been polished at predetermined surface roughness.

Casting type-polyurethane obtained by reacting ether-based polyol and polyisocyanate is used to the elastic layer 22 made of urethane rubber as the main component. In addition, conductive agent is compounded into the elastic layer 22. The conductive agent is not limited in particular if the conductive agent gives electron conductivity. Carbon black with a primary particle diameter of 15 nm-40 nm is used as the conductive agent, for example.

And then, as the treatment solution used for the surface treatment of the elastic layer 22, treatment solution made of urethane component made of urethane prepolymer as main component is used. The urethane prepolymer is made of isocyanate compound and polyol. The isocyanate compound includes 2,6-tolylene diisocyanate (TDI), 4,4'-diphenylmethane diisocyanate (MDI), paraphenylene diisocyanate (PPDI), 1,5-naphthalene diisocyanate (NDI), 3,3-dimethyl diphenyl-4,4'-diisocyanate (TODI), hexamethylene diisocyanate (HDI) and the like. In addition, carbon black with a primary particle diameter of 15 nm-40 nm, and silicone-based particles with a primary particle diameter of 0.5 μm-2.0 μm as silicone-based additive are respectively added at 2-40% by weight to urethane prepolymer component in the treatment solution. When the elastic layer 22 is dipped in treatment solution, the urethane prepolymer component in the treatment solution soaks in the urethane rubber of the elastic layer 22. In addition, the carbon black and the silicone-based additive in the treatment solution remain on the surface of the elastic layer 22.

In addition, the organic solvent used for treatment solution is not limited in particular if the organic solvent dissolves urethane prepolymer component (isocyanate compound). Ethyl acetate, methyl ethyl ketone, toluene or the like are used as the organic solvent, for example. The organic solvent in the treatment solution volatilizes from the elastic layer 22 after the elastic layer 22 has been dipped in the treatment solution.

Figure 3C:
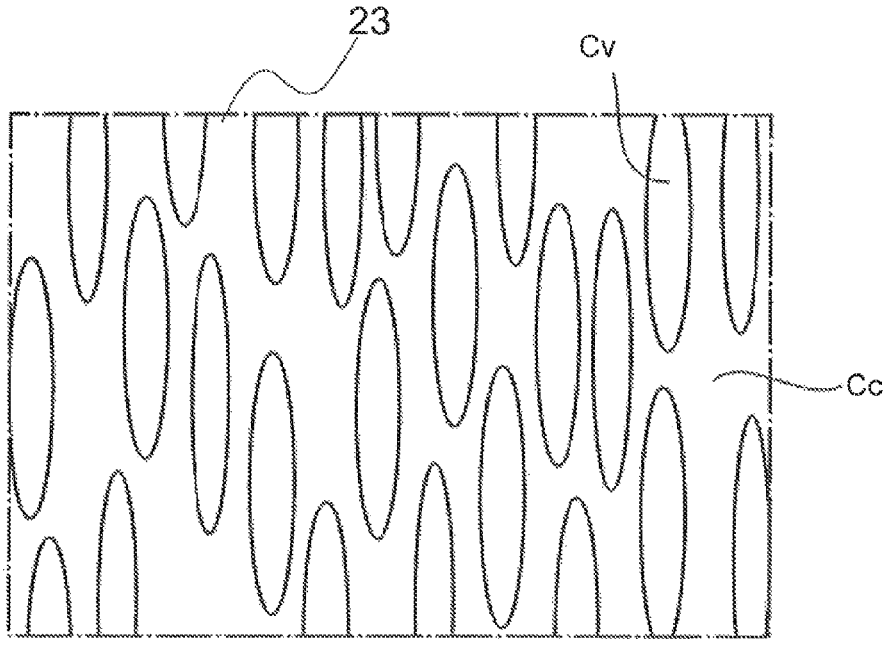
FIG. 3C is an enlarged view of a surface of the development roller.
Figure 3D:
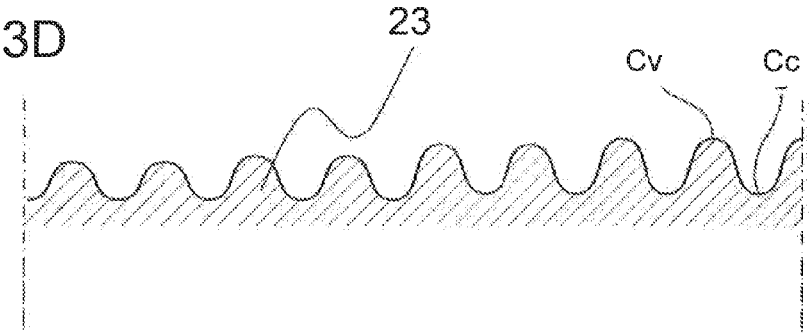
FIG. 3D is an enlarged view of a top layer in FIG. 3B, illustrating only a general structure.

FIG. 3C illustrates an enlarged view of a surface of the development roller 5 on which the surface treatment is performed using such a treatment solution. FIG. 3D illustrates an enlarged view of the top layer in FIG. 3B. As illustrated in FIGS. 3C and FIG. 3D, convex parts Cv made of urethane component as a main component and concave parts Cc made of silicone component as a main component are formed on the top layer 23. FIG. 3D does not illustrate a specific cross-section of FIG. 3C. It only illustrates a general shape in which the convex parts Cv and concave parts Cc are alternately arranged.

Figure 4A:
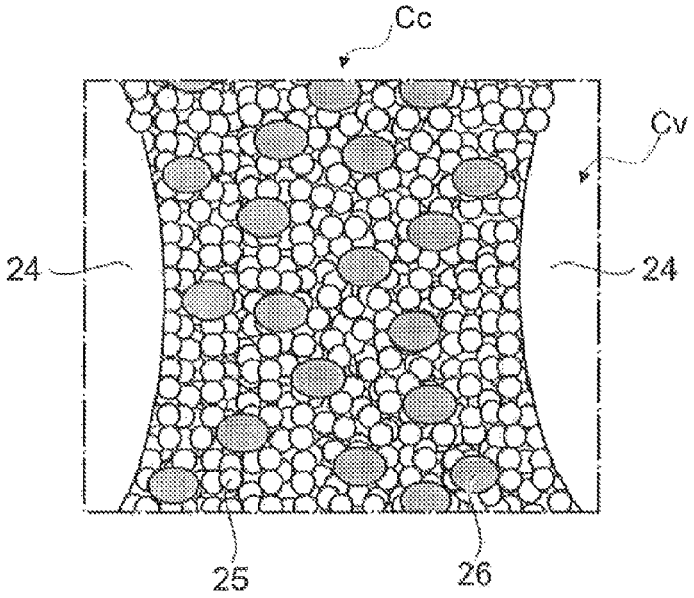
FIG. 4A is a partially enlarged view in FIG. 3C.
Figure 4B:
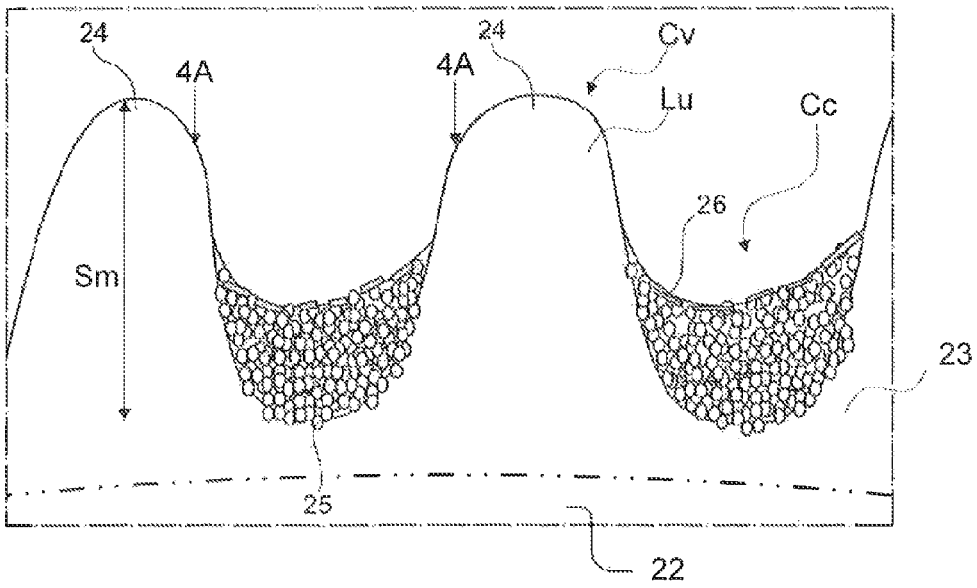
FIG. 4B is a cross-sectional view in FIG. 4A.

Specifically, as illustrated in FIGS. 4A (partially enlarged view in FIG. 3C) and 4B (cross-sectional view in FIG. 4A), the top layer 23 includes a penetration layer Lu that includes urethane prepolymer component that has penetrated in the elastic layer 22 and the surface of the elastic layer 22. The convex parts Cv are mainly configured by urethane component 24. The concave parts Cc between the convex parts Cv are configured by silicone component 26 laminated on innumerable existing particles of carbon black 25. The top layer is configured as described above since silicone-based additive and carbon black easily accumulate between the concave parts Cc due to action of surface tension as a result of a manufacturing method and forces according to their mutual influence are weak.

Next, a development process by the development device 1 that includes the above-described configuration is explained.

When an image formation instruction is input from a controller (not illustrated), the drive control part (not illustrated) starts rotation of the drive motor. When the drive motor starts to rotate, a drive force thereof is transmitted to a drum gear via a plurality of gears (not illustrated) arranged in the printer 100 main body, and the photosensitive drum 4 starts to rotate.

In addition, the development roller 5 starts to rotate when the drive force is transmitted from the drum gear to a development roller gear. In the same manner as described above, the supply roller 6 starts to rotate when the drive force is transmitted from the development roller gear to a supply roller gear via an idler gear.

In the meantime, at the same time of this, the charge roller 7 starts to rotate when the drive force is transmitted from the drum gear to a charge roller gear, and transfer roller 14 starts to rotate when the drive force is transmitted from the drum gear to a transfer roller gear. The respective arrows in FIG. 2 indicate rotation directions of the respective rollers and the photosensitive drum 4.

And then, the surface of the photosensitive drum 4 is uniformly and evenly charged by the charge roller bias voltage (e.g. −600 V) applied to the charge roller 7 and the rotation of the charge roller 7. When a charged part of the surface of photosensitive drum 4 arrives under the LED head 13, the LED head 13 emits light based on the input image information to form a latent image on the surface of the photosensitive drum 4 in accordance with the control of the head drive control part (not illustrated).

A −305 V supply roller bias voltage is applied to the supply roller 6, for example. A −205 V development roller bias voltage is applied to the development roller 5, for example. When the latent image part formed on the surface of photosensitive drum 4 arrives at the development roller 5, a thin layer of the toner 3 on the development roller 5 by the restriction blade 8 is attached on the latent image part on the surface of photosensitive drum 4 by a potential difference between the latent image on the surface of photosensitive drum 4 (e.g. −20V) and the development roller 5. Thereby, the latent image part is visualized and the developer image is developed. The development process starts when the rotation of the photosensitive drum 4 starts at predetermined timing in an image formation process by the printer 100 explained below.

Next, the image formation process by the printer 100 is explained.

Each of the sheets P accommodated in the sheet supply cassette 10 illustrated in FIG. 1 is picked up from the sheet supply cassette 10 by the sheet feeding roller in the arrow direction in FIG. 1. After that, the sheet P is carried to the development device 1 along the medium carrying path while the skew of the sheet P is corrected by the carrying roller 11. The development process discussed above starts at the predetermined timing while the sheet P is carried to the development device 1.

And then, a transfer process to transfer the developer image formed on the surface of the photosensitive drum 4 to the sheet P in the above-described development process is performed by the transfer roller 14 to which the transfer bias voltage applied by a power source for the transfer roller (not illustrated).

After that, the sheet P is carried to the fuser device 15 that includes the fuser roller 151 and the pressure application roller 152. The sheet P, on which the developer image is transferred, is carried between the fuser roller 151 and the pressure application roller 152 controlled by the temperature control part (not illustrated) and maintained at a predetermined surface temperature. Thereafter, heat of the fuser roller 151 melts the toner 3 on the sheet P. Moreover, the developer image is fixed on the sheet P by applying pressure to the toner 3 melted on the sheet P at the contact part between the fuser roller 151 and the pressure application roller 152.

The sheet P, on which a developer image is fixed, is ejected to the sheet ejection tray 16.

Fog toner and transfer residual toner may remain on the surface of the photosensitive drum 4 to which the developer image has been transferred. The toner that remains is removed by the cleaning blade 9. The cleaning blade 9 is arranged to abut on the predetermined position of the surface of the photosensitive drum 4, and removes the toner that remains while the photosensitive drum 4 rotates. The cleaned photosensitive drum 4 is reused.

FIRST EXAMPLE

The photosensitive drum 4 according to a first example was an organic photosensitive body configured by an aluminum shaft as the metal shaft, the electric charge generation layer and the electric charge transportation layer as the photosenductive layers layered on the outer circumferential surface of the aluminum shaft in order. The photosensitive drum 4 had an outer diameter of 30.0 mm. The development roller 5 was pushed into the photosensitive drum 4 with a depth of 0.1 mm The toner 3 according to the first example was a negatively charged crashed type formed of a non-magnetic one-component, and had an average volume particle size of 5.5 μm. Binder resin of the toner 3 was made of polyester resin. The toner 3 had a saturated electric charge amount of −44 μm/g.

The supply roller 6 according to the first example had an outer diameter of 15.8 mm. The supply roller 6 was configured by a metal shaft with a diameter of 6 mm made of SUM and a conductive sponge layer formed on an outer circumferential surface of the metal shaft. The center part of the supply roller 6 was in a crown shape, and had a diameter of 16.2 mm. In addition, a distance between centers of the supply roller 6 and the development roller 5 was set to be 14.75 mm.

The restriction blade 8 according to the first example was made of SUS with a thickness of 0.08 mm. The restriction blade 8 had a curvature part in the front edge part of the one end side thereof that abuts on the development roller 5. The curvature part had a curvature radius R of 0.18 mm, and the restriction blade 8 had a surface roughness Rz of 0.6 μm measured with a ten-point average surface roughness measurement method.

The development roller 5 according to the first example included the elastic layer 22 formed on the outer circumferential surface of the core 21 with a radius of 12 mm and made of urethane rubber as the main component. And then, the polishing treatment was performed on the surface of the elastic layer 22 so that the surface thereof had a surface roughness Rz of 5-10 μm, preferably approximately 7 μm, (JIS B0601-1994) measured with the ten-point average surface roughness measurement method.

(Adjustment of Treatment Solution)

For the treatment solution according to the first example, 100 parts by weight of ethyl acetate, 20 parts by weight of urethane prepolymer (urethane component), 2 parts by weight of silicone-based additive and 3 parts by weight of carbon black were compounded and mixed to disperse by a ball mill for 3 hour.

(Elastic Layer Surface Treatment)

The elastic layer 22 that indicated the above-described surface roughness was dipped in the treatment solution maintained at the temperature of 23° C. for 30 seconds using a dipping method. After 30 seconds, the elastic layer 22 was pulled out from the treatment solution. The treatment solution attached on the elastic layer 22 was immediately cleaned with non-woven fabric. After that, the elastic layer 22 was heated in an oven maintained at the temperature of 120° C. for 1 hour to form the top layer 23.

The elastic layer 22 is preferably cleaned with non-woven fabric within 2 minutes after it was pulled out from the treatment solution. The top layer 23 formed as described above had an interval Sm of 10 μm between the convex part Cv and the concave part Cc thereof.

FIRST COMPARATIVE EXAMPLE

Figure 5A:
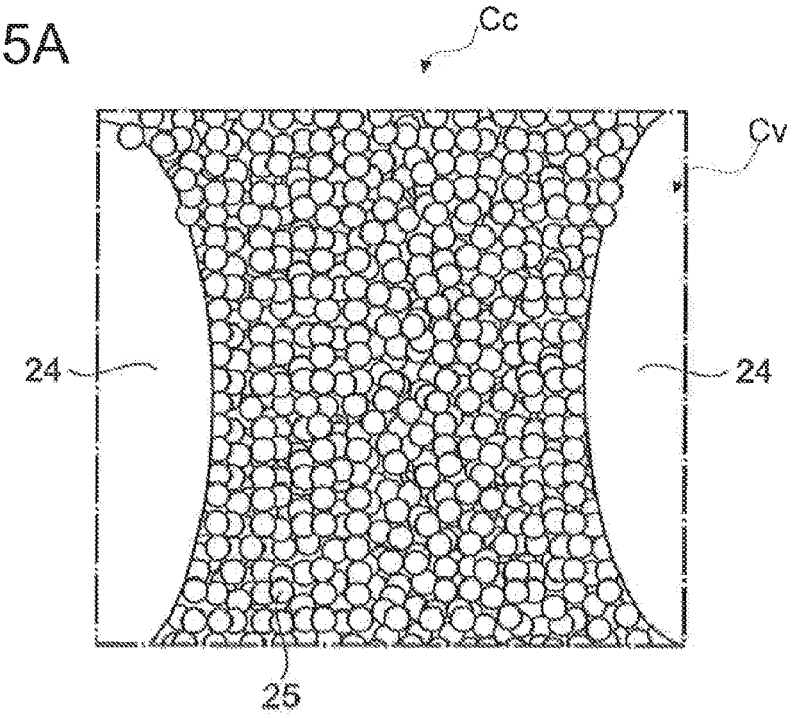
FIG. 5A is a partially enlarged view of a surface of the development roller according to a first comparative example.
Figure 5B:
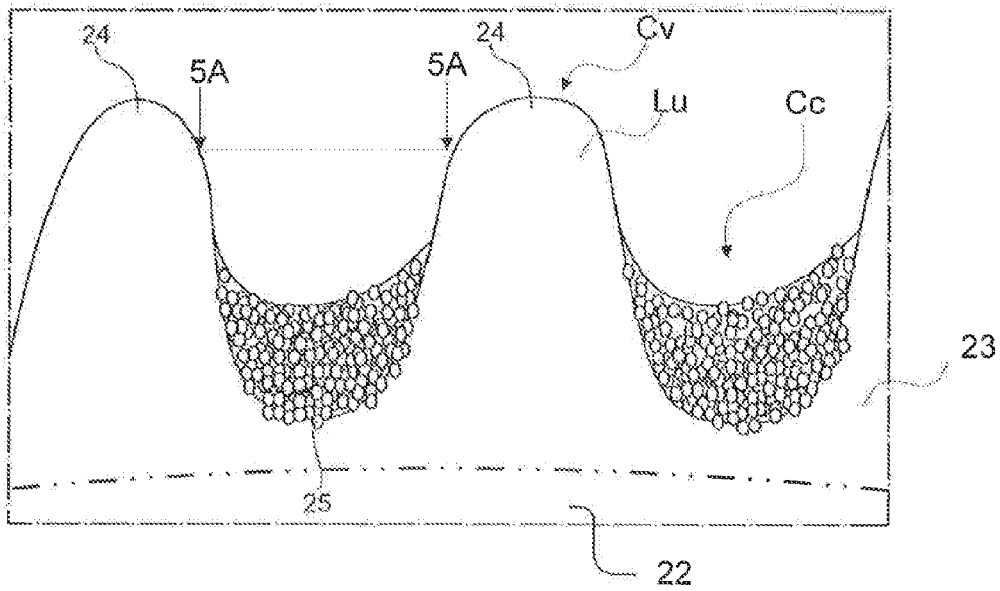
FIG. 5B is a cross-sectional view in FIG. 5A.

In the same manner as the example, the development roller 5 according to a first comparative example included the elastic layer 22 formed on the outer circumferential surface of the core 21 with a radius of 12 mm and made of urethane rubber as the main component. However, the top layer 23 was configured only by the urethane component. FIG. 5A is a partially enlarged view of a surface of the development roller 5 according to the first comparative example. FIG. 5B is a cross-sectional view in FIG. 5A. As illustrated in FIGS. 5A and 5B, convex parts that configure the top layer 23 are mainly configured by the urethane component 24. Concave parts between the convex parts are configured by innumerable existing particles of carbon black 25. In addition, the penetration layer Lu that includes urethane prepolymer component that has penetrated in the elastic layer 22 was formed on the top layer 23.

(Adjustment of Treatment Solution)

For the treatment solution according to the first comparative example, 100 parts by weight of ethyl acetate, 20 parts by weight of urethane prepolymer (urethane component) and 3 parts by weight of carbon black were compounded and mixed to disperse by a ball mill for 3 hour.

(Elastic Layer Surface Treatment)

The elastic layer 22 that indicated substantially same surface roughness as the first example was dipped in the treatment solution maintained at the temperature of 23° C. for 30 seconds using a dipping method. After 30 seconds, the elastic layer 22 was pulled out from the treatment solution. The treatment solution attached on the elastic layer 22 was immediately cleaned with non-woven fabric. After that, the elastic layer 22 was heated in an oven maintained at the temperature of 120° C. for 1 hour to form the top layer 23.

SECOND COMPARATIVE EXAMPLE

Figure 6A:
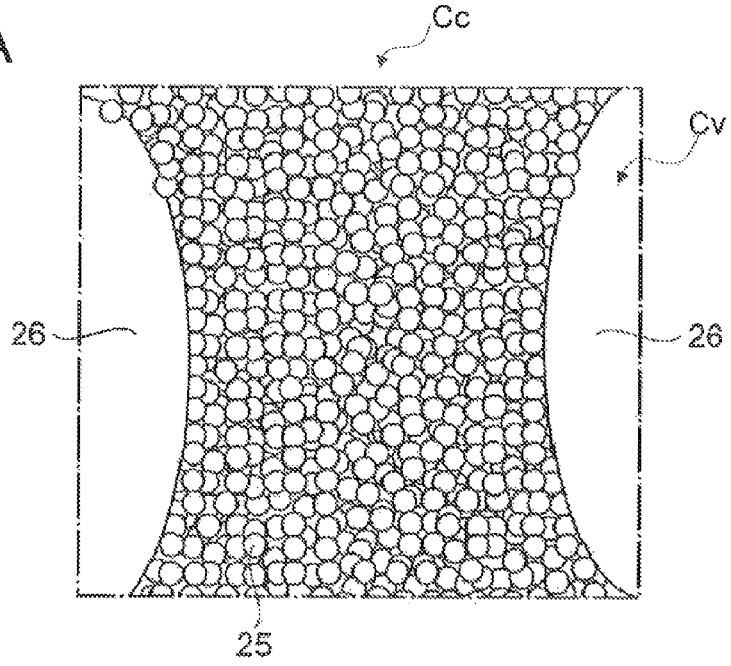
FIG. 6A is a partially enlarged view of a surface of the development roller according to a second comparative example.
Figure 6B:
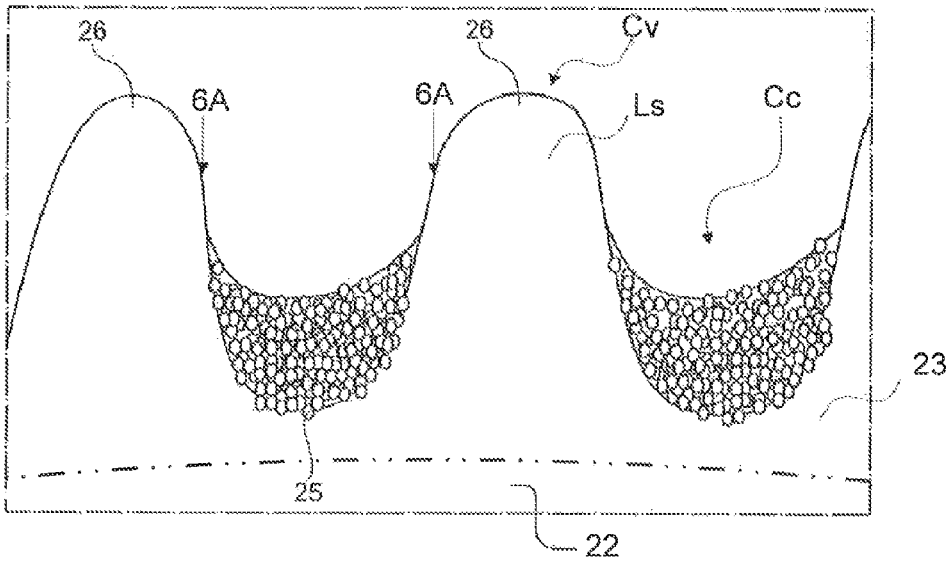
FIG. 6B is a cross-sectional view in FIG. 6A.

In the same manner as the example, the development roller 5 according to a second comparative example included the elastic layer 22 formed on the outer circumferential surface of the core 21 with the radius of 12 mm and made of urethane rubber as the main component. However, the top layer 23 was configured only by the silicone component. FIG. 6A is a partially enlarged view of a surface of the development roller 5 according to the second comparative example. FIG. 6B is a cross-sectional view in FIG. 6A. As illustrated in FIGS. 6A and 6B, convex parts that configure the top layer 23 are mainly configured by silicone component 26. Concave parts between the convex parts are configured by innumerable existing particles of carbon black 25. In addition, a penetration layer Ls that includes silicon resin has penetrated therein is formed.

(Adjustment of Treatment Solution)

For the treatment solution according to the second comparative example, 100 parts by weight of ethyl acetate, 20 parts by weight of silicone resin (silicone component) and 3 parts by weight of carbon black were compounded and mixed to disperse by a ball mill for 3 hour. The three types of treatment solution are compared in table 1.

TABLE 1

| | Example | First Comparative Example | Second Comparative Example |
|---|---|---|---|
| Ethyl Acetate | 100 | 100 | 100 |
| Urethane Prepolymer | 20 | 20 | N/A |
| Silicone Resin | N/A | N/A | 20 |
| Carbon Black | 3 | 3 | 3 |
| Silicone-Based Particles | 2 | N/A | N/A |

(Elastic Layer Surface Treatment)

The elastic layer 22 that indicated substantially same surface roughness as the first example was dipped in the treatment solution maintained at the temperature of 23° C. for 30 seconds using a dipping method. After 30 seconds, the elastic layer 22 was pulled out from the treatment solution. The treatment solution attached on the elastic layer 22 was immediately cleaned with non-woven fabric. After that, the elastic layer 22 was heated in an oven maintained at the temperature of 120° C. for 1 hour to form the top layer 23.

Next, the respective produced development rollers according to the first example, the first comparative example and the second comparative example were used and a white sheet fog evaluation and a print evaluation were performed.

An electrographic printer C8800 do (resolution of 600 dpi, by Oki Data Corporation) was used for image printing. The toner was a negatively charged crashed type formed of a non-magnetic one-component, and had an average volume particle size of 5.5 μm. And then, a rotational speed of the photosensitive drum was 106 rpm, and a print speed was 33 ppm during printing. As bias conditions during the printing, the charge roller bias voltage was −1050 V, the photosensitive drum surface potential difference was approximately −600 V, the development roller bias voltage was −205 V, and the supply roller bias voltage was −305 V. Printing was performed under an environment with the temperature of 23° C. and the relative humidity of 45 RH %. An initial development device was used in the present evaluation.

(White Sheet Fog Evaluation)

A white sheet was stopped during developing under the above-described image printing conditions. Then, an adhesive tape (Scotch tape, by Sumitomo 3M Limited) was attached to the toner on the photosensitive drum after an image was developed and before the image was transferred, and the adhesive tape was attached to the sheet as a white sheet. And then, a spectrometer (CM-2600d, by Konica Minolta Holdings, Inc.) was used for measuring a color difference ΔE of the sheet before and after the adhesive tape was attached. When the color difference ΔE was small, an amount of the toner causing the fog was small. When the color difference ΔE was greater than 1.0, the fog on the adhesive tape was visibly checked readily. In the present evaluation, when the color difference ΔE was smaller than 1.0, the result was represented as favorable (○). When the color difference ΔE was equal to or greater than 1.0, the result was represented as poor (X).

(Print Evaluation)

In the print evaluation, a density of a printed image obtained after a pattern with an image area density of 100% density has been printed on the sheet was evaluated. A density at 15 mm from an upper part of the sheet seen from a print direction was measured with a spectrum density meter X-Rite 528 (made by X-RITE Inc.). Here, when an optical density (OD) value was smaller than 1.4, the density is unsatisfied. In the present evaluation, when the OD value was equal to or greater than 1.4, the result was represented as favorable (○). When the OD value was smaller than 1.4, the result was represented as poor (X).

Table 2 illustrates results of the white sheet fog evaluation and the print evaluation.

TABLE 2

| Development Roller | | Example | First Comparative Example | Second Comparative Example |
|---|---|---|---|---|
| Initial Fog | ΔE | 0.52 | 1.04 | 0.23 |
| | Evaluation | ○ | X | ○ |
| Initial Density | OD Value | 1.47 | 1.52 | 1.06 |
| | Evaluation | ○ | ○ | X |

As illustrated in Table 2, in the example, a value of an initial density (result of the print evaluation) was 1.47, which was ○. A value of initial fog (result of the white sheet fog evaluation) was 0.52, which was ○. It is considered that this is because no positive electric charges accumulate on the silicone component, and successfully flow since the surface structure of the development roller according to the example includes the convex parts made of urethane component as the main component and the concave parts formed of silicone component in upper triboelectric series and the carbon black (conductive agent). The silicone component is laminated on the carbon black. In addition, the toner is effectively charged since the concave parts includes sea parts made of carbon black and island parts made of silicone component, which is so-called sea-island structure. From these structures, it is considered that both of the high evaluation in the print evaluation and the suppression of generation of fog in the white sheet fog evaluation were realized in the example.

In comparison with the example, in the first comparative example, a value of an initial density was 1.52, which was ○. A value of initial fog was 1.06, which was X. Generally, it is known that the generation of fog results from a charge performance of a development roller. Accordingly, it is considered that the generation of fog was not suppressed due to an insufficient charge performance of a development roller in the first comparative example in which the top layer is configured only by urethane component.

And then, in the second comparative example, a value of an initial density was 1.06, which was X. A value of initial fog was 0.23, which was ○. The silicone resin used in the second comparative example is in upper triboelectric series, and has a high charging characteristic. Accordingly, the silicone resin according to the second comparative example is effective for the suppression of the generation of fog, however, easily accumulates positive electric charges, which are opposite to a charging characteristic of the toner. Moreover, positive electric charges do not successfully flow in comparison with the example since the convex parts is mainly configured by silicone component and the distribution of the carbon black is small in the second comparative example. As a result, it is considered that the charged toner remained on the surface of the development roller, which resulted in the low evaluation in the print evaluation. Moreover, the carbon black (conductive agent) has a feature that easily agglomerates. The carbon black cannot be provided in the vicinity of the silicone component (under or in the periphery of the silicone component) since the carbon black remains in the concave parts due to the action of surface tension as a result of a manufacturing method, which resulted in the low evaluation in the print evaluation.

The above-described results show that it is necessary to include the urethane component in the convex parts of the top layer of the development roller and silicone component in the concave parts and that to provide the conductive agent that flows positive electric charges under or in the periphery of the silicone component in order to realize both of the high evaluation in the print evaluation and the suppression of the generation of the fog in the white sheet fog evaluation.

A development roller is charged low, when the roller is combined with a fresh negatively charged toner which started to be used. As a result, the toner can be attached to a non image region and fog can be generated. Therefore, there is a method that adjusts surface roughness of a surface of a development roller to improve a charge performance of the development roller side so as to suppress generation of fog. However, problems such as development roller toner filming, scumming and greasing occur, and thereby it is difficult to realize both of the high evaluation in the print evaluation and the suppression of the generation of the fog in the white sheet fog evaluation. On the other hand, according to the first embodiment of the present invention, by including the urethane component in the convex parts of the top layer of the development roller and silicone component in the concave parts and providing the conductive agent that flows positive electric charges under or in the periphery of the silicone component, both of the high evaluation in the print evaluation and the suppression of the generation of the fog in the white sheet fog evaluation are realized.

[Second Embodiment]

In second embodiment, improvement of the durability, which is the problem of the conventional art, that is, a condition that solves the generation of the development roller toner filming was examined. Later-described examples and comparative examples show adjusted compound ratios of the isocyanate compound and the polyol explained in the first embodiment. Further, both end of the core of the development roller was fixed so that a hardness of the surface of the development roller was measured with an ASKER C hardness meter (by Kobunshi Keiki Co., Ltd.). Regarding a measuring method of ASKER C hardness, JP Laid-Open Application Publications 2012-127990 and 2012-014089 are incorporated herein by reference.

Second example: hardness 77°

Third example: hardness 78°

Fourth example: hardness 80°

Third comparative example: hardness 75°

Fourth comparative example: hardness 83°

Next, the respective produced development rollers according to the second, third and fourth examples and the third and fourth comparative examples were used, and an image printing durability test, a print evaluation (development roller toner filming) and a leaving evaluation (development roller periodical stripes evaluation) were performed.

An electrographic printer C8800 do (resolution of 600 dpi, by Oki Data Corporation) was used for the image printing durability test. The toner was a negatively charged crashed type formed of a non-magnetic one-component, and had an average volume particle size of 5.5 μm. And then, a rotational speed of the photosensitive drum was 106 rpm, and a print speed was 33 ppm during printing. As bias conditions during the printing, the charge roller bias voltage was −1050 V, the photosensitive drum surface potential difference was approximately −600 V, the development roller bias voltage was −205 V, and the supply roller bias voltage was −305 V. Print was performed under an environment with the temperature of 23° C. and the relative humidity of 45 RH %. An initial development device was used in the present evaluation. As the sheet, Excellent White (A4 size, by Oki Data Corporation) was used. The sheet was placed in a landscape orientation to perform a continuous print test. For images of the test, a pattern with an image area density of 100% density was printed on 3% of the print page number, and a white pattern was printed on the rest. In addition, the continuous printing was performed so that the print page number reached 35,000.

Print Evaluation (Development Roller Toner Filming)

In the print evaluation, a density of a printed image obtained after a pattern with an image area density of 100% density has been printed on the sheet was evaluated. Respective densities at 15 mm from an upper part and a lower part of the sheet seen from a print direction were measured with the spectrum density meter X-Rite 528 (made by X-RITE Inc.). Here, when a upper and lower density difference between optical density (OD) values of the upper part and the lower part was equal to 0.2 or more, the density difference is remarkable. When the upper and lower density difference was smaller than 0.2, the result was represented as favorable (○). When the upper and lower density difference was equal to or greater than 0.2, the result was represented as poor (X).

Leaving Evaluation (Development Roller Periodical Stripes Evaluation)

In the leaving evaluation, after the development roller was left without rotating under an environment with the temperature of 50° C. and the relative humidity of 55 RH % for one month, a pattern with an image area density of 50% density was printed on the sheet, and generation of stripes of rotation period of the development roller was checked. Here, when no development roller periodical stripes were checked, the result was represented as favorable (○). When development roller periodical stripes were checked, the result was represented as poor (X).

Table 3 illustrates results of the print evaluation (development roller toner filming) and the leaving evaluation (development roller periodical stripes evaluation).

TABLE 3

| | | Example And Comparative Example | | | | |
|---|---|---|---|---|---|---|
| | | Third Comparative Example | Second Example | Third Example | Fourth Example | Fourth Comparative Example |
| ASKER C Hardness | | 75 | 77 | 78 | 80 | 83 |
| Durability Test | Density Difference | 0.09 | 0.10 | 0.10 | 0.12 | 0.20 |
| | Evaluation | ○ | ○ | ○ | ○ | X |
| Leaving Evaluation | Development Roller Periodical Stripes Evaluation | X | ○ | ○ | ○ | ○ |

As illustrated in Table 3, when ASKER C hardness of the top layer was 75°, which was too low (third comparative example), a depression of a contact part (nip part) between the photosensitive drum and development roller grew, and stripes of rotation period of the development roller were remarkably generated. On the other hand, when ASKER C hardness of the top layer was 83°, which was too high (fourth comparative example), deterioration of the toner was promoted since a burden to the toner increased, a print density decreased, and development roller toner filming was generated.

And then, as second, third and fourth examples, when ASKER C hardness ranged from 77° to 80°, degrees of the toner filming and the depression on the development roller were favorable in the durability test.

As described above, according to the second embodiment, the effects of the first embodiment are obtained. And then, when the hardness of the surface of the development roller ranges from 77° to 80° (ASKER C hardness), the durability is improved, that is, the generation of the development roller toner filming is solved.

The embodiments according to the present invention are explained with a printer as one example and as an image forming apparatus. However, the present invention may be implemented in, for example, a multi function peripherals (MFP), a facsimile machine, a photocopy apparatus, and the like as well as a printer.

What is claimed is:

1. A development device, comprising:

a developer carrier configured to supply developer on a latent image formed on a latent image carrier to visualize the latent image, wherein the developer carrier includes:

an elastic layer formed on an outer circumferential surface of a conductive support body, the elastic layer including urethane rubber; and a top layer formed by treating a surface of the elastic layer with treatment solution that includes urethane polymer, silicone-based additive and conductive agent;

the top layer includes:

convex parts that include the urethane rubber; and concave parts in which the silicone-based additive and the conductive agent are laminated.

2. The development device according to claim 1, wherein the conductive agent is positioned under the silicone-based additive in the concave parts.

3. The development device according to claim 2, wherein the convex parts are formed of urethane component.

4. The development device according to claim 1, wherein the silicone-based additive is silicone-based particles.

5. The development device according to claim 4, wherein surfaces of the concave parts are formed in a sea-island structure in which the conductive agent forms a sea part and the silicone-based particles forms island parts.

6. The development device according to claim 1, wherein the conductive agent is carbon black.

7. The development device according to claim 1, wherein ASKER C hardness of the top layer ranges from 77° to 80°.

8. The development device according to claim 1, wherein the developer is negatively charged.

9. The development device according to claim 1, wherein the top layer includes a penetration layer in which the urethane prepolymer has penetrated in the urethane rubber.

10. An image forming apparatus, comprising the development device according to claim 1.

11. The development device according to claim 1, wherein a surface of the elastic layer has a surface roughness of 5-10 μm which is measured with a ten-point average surface roughness measurement method.

12. The development device according to claim 11, wherein the ten-point average surface roughness measurement method is based on JIS B0601-1994.

13. The development device according to claim 1, wherein the conductive agent is carbon black of which a primary particle diameter ranges from 15 nm-40 nm, and the silicone-based additive is silicone-based particles of which a primary particle diameter ranges from 0.5 μm-2.0 μm.

* * * * *